United States Patent [19]

Tharp et al.

[11] Patent Number: 4,837,669

[45] Date of Patent: Jun. 6, 1989

[54] LOW PROFILE INDUSTRIAL LUMINAIRE

[75] Inventors: Terry M. Tharp; David W. Roberts; John C. McCartney; John W. Harvey, all of Newark, Ohio

[73] Assignee: Manville Corporation, Denver, Colo.

[21] Appl. No.: 7,889

[22] Filed: Jan. 28, 1987

[51] Int. Cl.[4] ..... F21S 1/02

[52] U.S. Cl. ..... 362/418; 362/147; 362/404

[58] Field of Search ..... 362/418, 382, 401, 404, 362/406, 428, 147, 150

[56] References Cited

U.S. PATENT DOCUMENTS

| | | | |
|---|---|---|---|
| 3,051,772 | 8/1962 | Davis | 362/150 X |
| 3,883,732 | 5/1975 | Peterson et al. | 362/150 X |
| 3,927,315 | 12/1975 | Werry | 362/382 |
| 4,162,779 | 7/1979 | Van Steenhoven et al. | 362/404 X |
| 4,368,506 | 1/1983 | Rapp | 362/418 X |
| 4,403,278 | 9/1983 | Flood | 362/404 X |
| 4,449,168 | 5/1984 | Ewing | 362/404 |

*Primary Examiner*—Larry Jones

*Attorney, Agent, or Firm*—John D. Lister; Cornelius P. Quinn

[57] ABSTRACT

A low profile HID light fixture comprising; a housing, means for mounting said housing, an optical assembly having a lamp contained therein, an electrical assembly having a ballast contained therein and means for mounting said optical assembly and said optical assembly and said electrical assembly in side by side relationship directly beneath said housing.

9 Claims, 4 Drawing Sheets

LOW PROFILE INDUSTRIAL LUMINAIRE

BACKGROUND OF THE INVENTION

The present invention relates to a low profile lighting fixture especially useful in areas where there is limited overhead space.

There is a need in industry to light work areas and the like where ceiling height is limited. Most prior art 400W HID light fixtures have an overall depth of 2.6 inches to 32 inches since they are designed with the electrical assembly mounted on a conduit and the optical assembly directly beneath the electrical assembly and are not suited for areas where overhead clearance needs to be kept at a maximum.

BRIEF SUMMARY OF THE INVENTION

One object of the present invention is to provide a low profile lighting fixture with an HID light source suited for areas where overhead clearance needs to be kept at a maximum.

Another object of the present invention is to provide a low profile HID lighting fixture which may be easily maintained.

Still another object of the present invention is to provide a low profile HID lighting fixture with the optical assembly and the electrical assembly side by side.

A further object of the present invention is to provide a low profile HID lamp fixture in which the electrical assembly and the optical assembly are mounted on plates that slide on and off a sheet metal or extruded housing.

Still a further object of the present invention is to provide a low profile HID lamp fixture in which means are provided to allow the optical assembly and the electrical assembly to swing down while still being supported by the fixture thereby allowing full access to the lamp compartment of the optical assembly or the ballast compartment.

Other objects and advantages of the present invention will become obvious from the drawings, specification and the appended claims.

Accordingly the present invention provides a low profile HID light fixture comprising, a housing, means for mounting said housing, an optical assembly having a lamp contained therein, an electrical assembly having a ballast contained therein and means for mounting said optical assembly and said electrical assembly in side by side relationship beneath said housing.

DETAILED DESCRIPTION AND PREFERRED EMBODIMENTS

Figure 1:
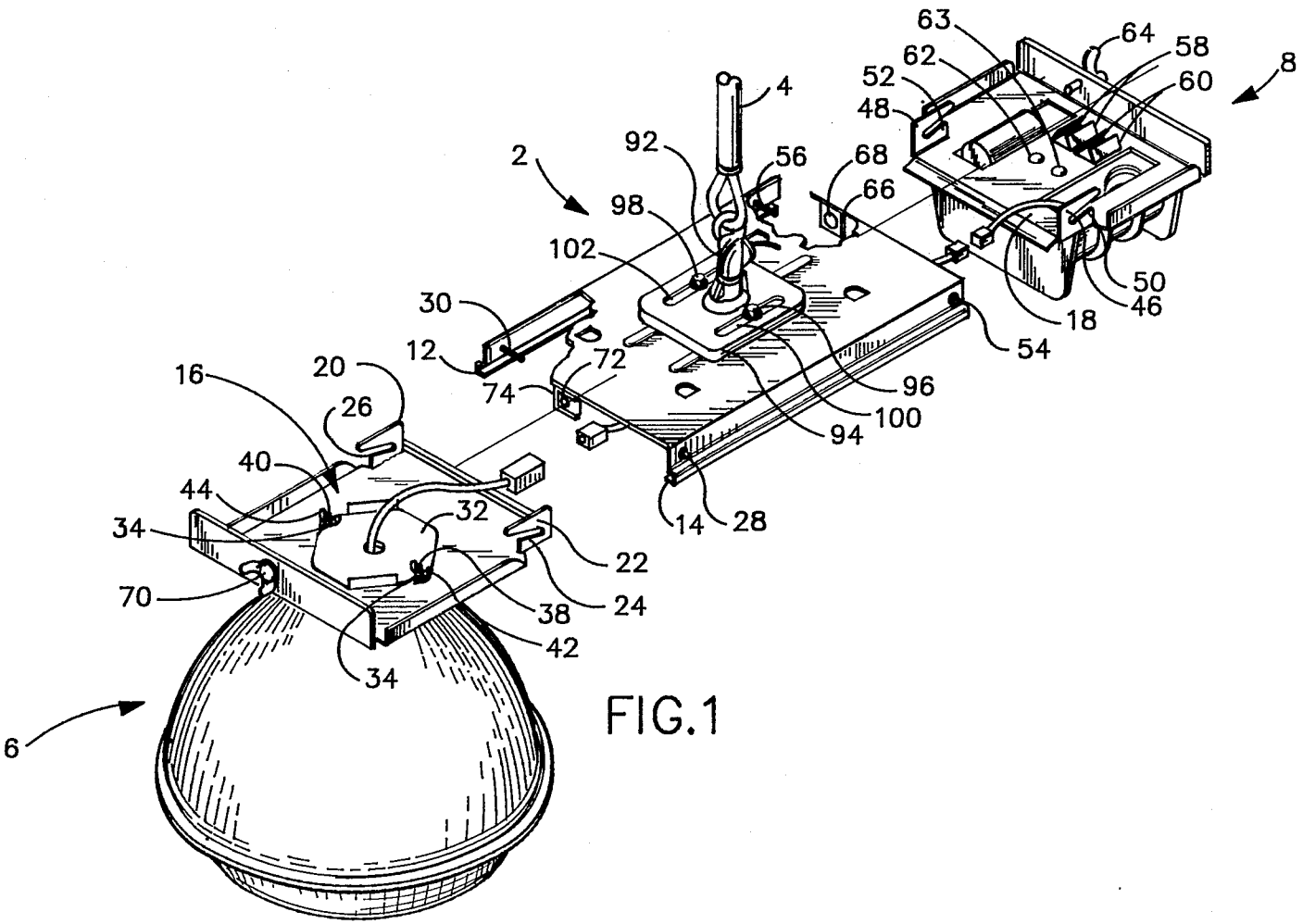
FIG. 1 is an exploded perspective view of a low profile HID lamp fixture in accordance with the present invention.
Figure 2:
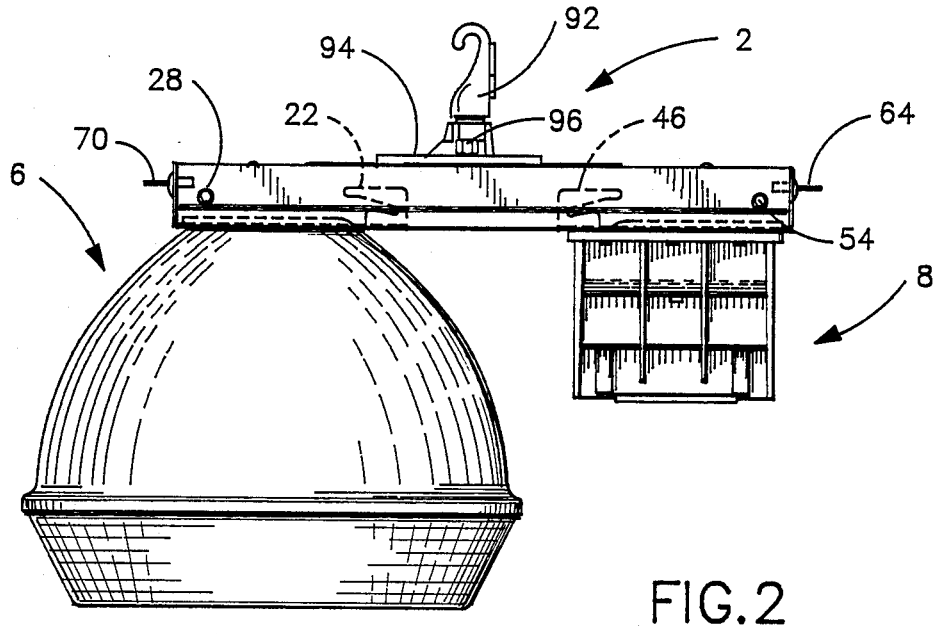
FIG. 2 is a front view of a low profile HID lamp fixture of the present invention showing the optical assembly and the electrical assembly locked in place and the plates fixed to said optical assembly and the electrical assembly supported by tracks formed in the housing.

Turning now to the drawings, wherein like components are designated by like reference numerals throughout the various figures, attention is specifically directed to FIG. 1 showing a low profile HID lamp fixture having a housing of sheet metal or the like generally identified by the reference numeral 2 hung from a conduit 4 an optical assembly generally identified by the reference numeral 6 and an electrical assembly generally identified by the reference numeral 8.

As illustrated in FIG. 1, parallel tracks 12 and 14 formed in said housing 2 are adapted to receive and support a sliding plate 16 of the optical assembly 6 and a sliding plate 18 of the electrical assembly 8.

The sides of track 12 and track 14 cooperate to limit the side movement of plates 16 and 18 while allowing the plates 16 and 18 to slide in and out of the housing 2 like a drawer.

Figure 4:
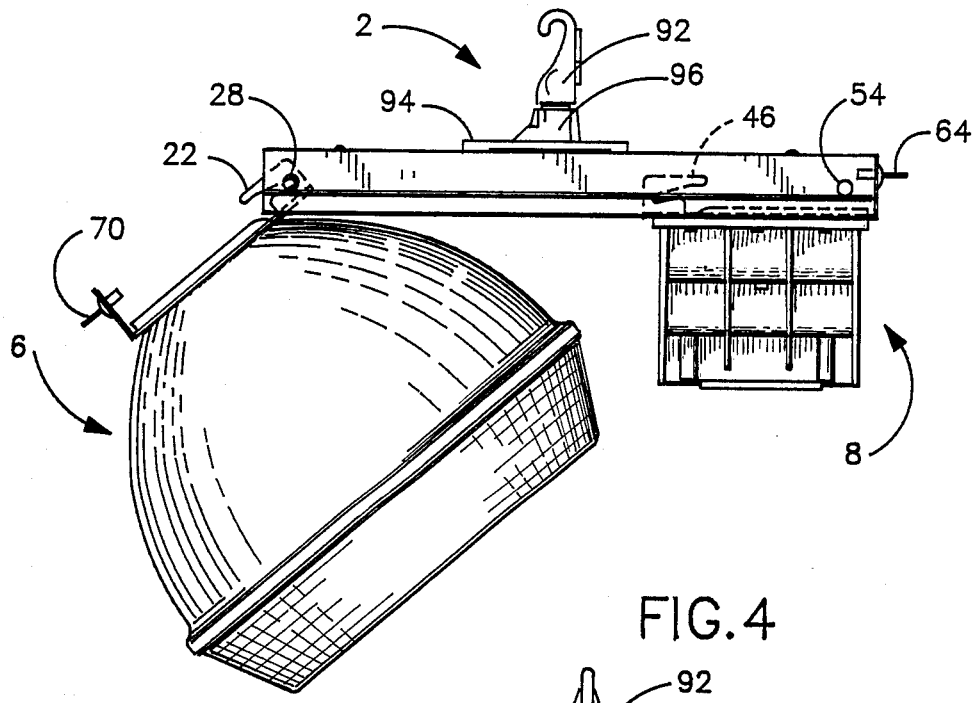
FIG. 4 shows the low profile HID lamp illustrated in FIG. 2 with the optical assembly slid out and swung down for service and maintenance.
Figure 7:
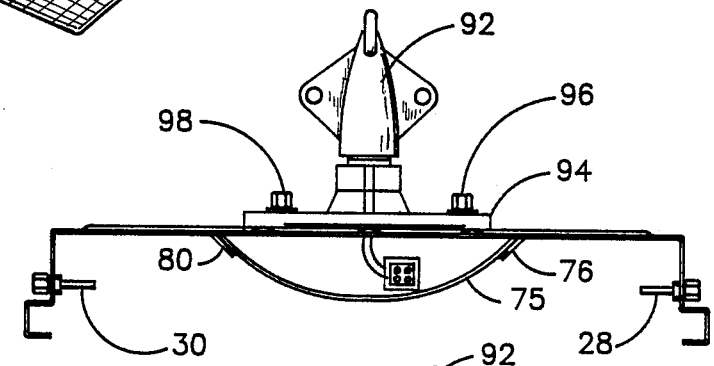
Figure 8:
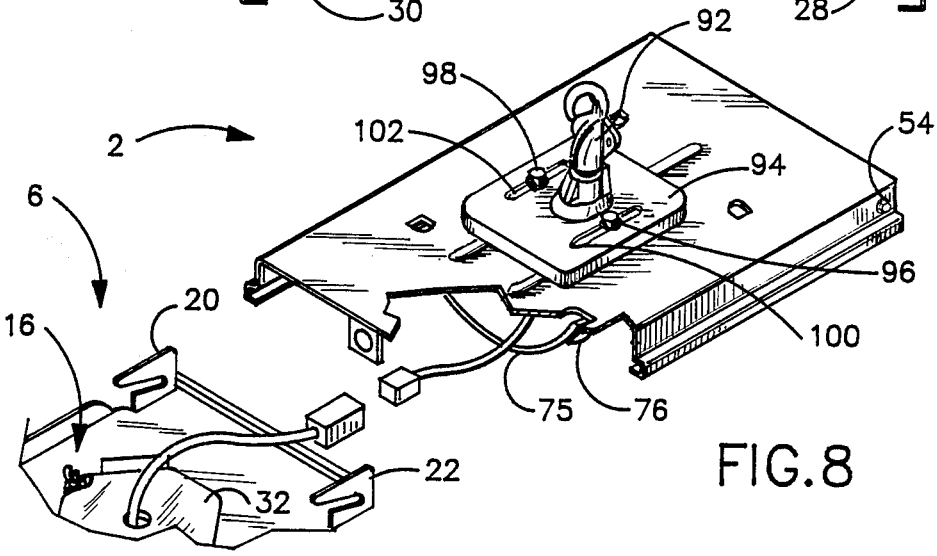

Special hinges 20 and 22 are formed on plate 16 with sloping grooves 24 and 26 therein to engage a pair of pins 28 and 30 mounted in the sides of the housing 2. When the plate 16 is pulled out of the housing 2 the hinges 20 and 22 engage the pins 28 and 30 and allow the optical assembly to swing down as shown in FIG. 4 while still being supported by the housing 2 for easy servicing of the optical assembly 6.

A lamp socket (not shown) is fixed to a socket mounting plate 32. The socket mounting plate 32 has two slots 34 and 36 for receiving two threaded posts 38 and 40 protruding from the optical assembly sliding plate 16. A pair of wind nuts 42 and 44 engage the threaded posts 38 and 40 to secure the socket mounting plate 32 in place.

Figure 3:
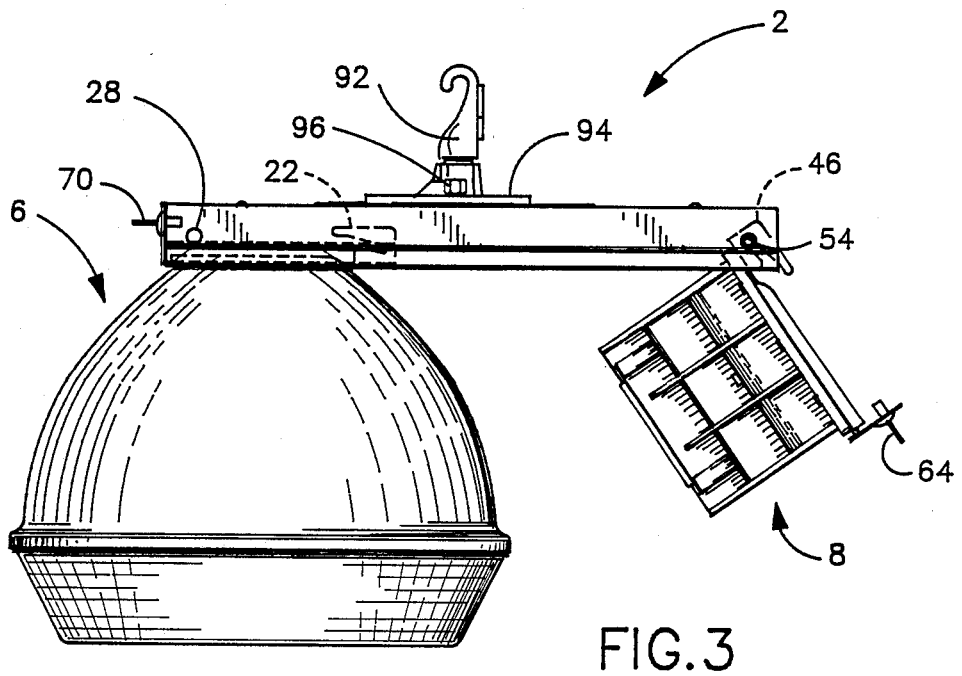
FIG. 3 shows the low profile HID lamp fixture illustrated in FIG. 2 with the electrical assembly slid out and swung down for service and maintenance.

Likewise special hinges 40 and 48 are formed on plate 18 with sloping grooves 50 and 52 therein to engage a pair of pins 54 and 56 mounted in the sides of housing 2. When the plate 18 is pulled out of the housing 2 the hinges 46 and 48 engage the pins 54 and 56 and allow the electrical assembly to swing down as shown in FIG. 3 while still being supported by the housing 2 for easy servicing of the electrical assembly 8.

Fusing for the unit (not shown) is held in place by two pairs of tabs 58 and 60 in plate 18 and is held in position by dimples 62 and 63 in plate 18.

The electrical plate 18 is locked into place in the closed position by a quarter turn fastener 64 engaging a locking nut 66 mounted on a tab 68 which is an integral part of the housing 2.

Similarly with the optical plate 16 it is loeked into place in its closed position by a quarter turn fastener 70 engaging a locking nut 72 which is an integral part of the housing 2.

Tabs 74 and 68 are offset to assure the ballast and optical plates are installed on the correct side.

Figure 5:
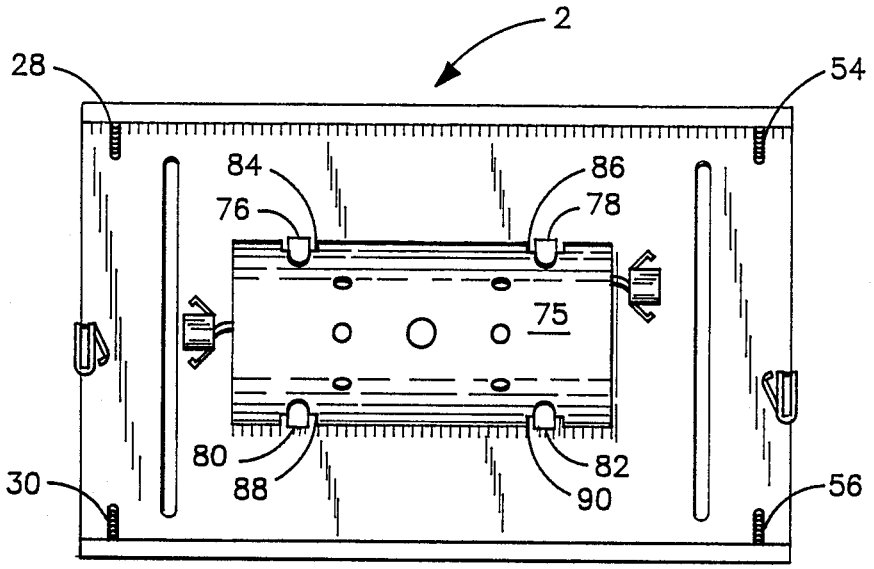
FIG. 5 shows the wire cover formed in the interior of the housing of low profile HID lamp illustrated in FIG. 1.

As shown in FIG. 5 a flat sheet 75 of high temperature polymer held in place by four tabs 76, 78, 80 and 82 is bowed to form a wire access cover. Notches 84, 86, 88 and 90 in flat sheet 75 interlock with the tabs 76, 78, 80 and 82 to properly locate the sheet 75 and prevent it from shifting.

Figure 6:
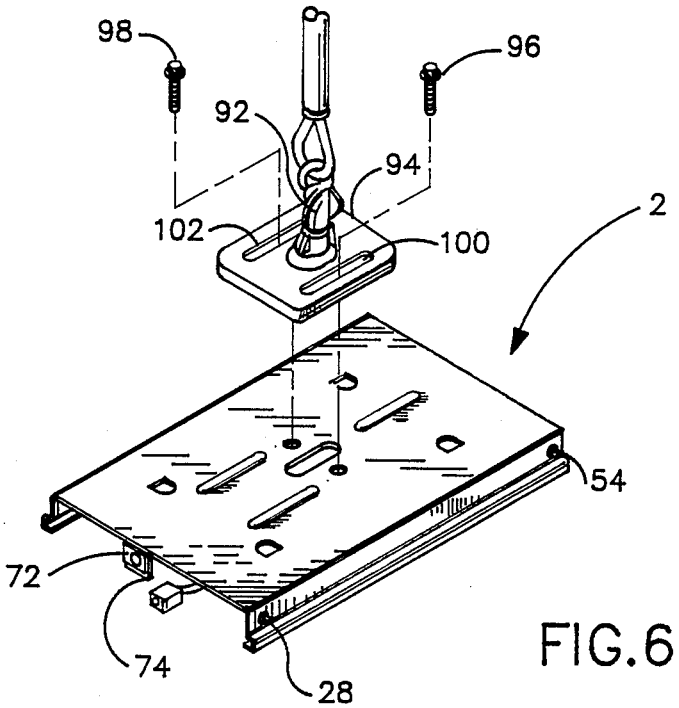
FIG. 6 shows the die cast adapter for balancing the low profile lamp of the present invention.

The unit as shown in FIG. 1 is mounted by a threaded hook 92 into a die cast adapter 94. As shown in FIG. 6 the cast adapter 94 is mounted on two screws protruding from two screws 96 and 98 threaded into the top of the housing 2 and the cast adapter has two slots 100 and 102 so that adapter 94 can slide relative to the housing 2 to allow the lighting fixture to be balanced.

We claim:

1. A low profile HID light fixture comprising; a housing, means for mounting said housing, an optical assembly having a lamp contained therein, an electrical assembly having a ballast contained therein and means for mounting said optical assembly and said electrical assembly in side by side relationship directly beneath said housing affording both independent and simultaneous access to each assembly for maintenance and replacement purposes, wherein said means for mounting said optical assembly in side by side relationship beneath said housing includes tracks formed in said housing and plates fixed to said optical assembly and said electrical assembly, said plates being adapted to ride in said tracks formed in said housing, and wherein each plate is mounted at ends of side housing opposite the other respective plate.

2. A low profile HID light fixture as recited in claim 1 wherein said track formed in said housing are shaped so as to permit said plates to slide in and out of said housing like a drawer.

3. A low profile HID light fixture as recited in claim 2 wherein said means for mounting said optical assembly and said electrical assembly means includes pivot means to allow the optical assembly and the electrical assembly to swing down while still being supported by said housing when said plates fixed to said optical assembly and said electrical assembly are slid out from contact with said tracks formed in said housing.

4. A low profile HID light fixture as recited in claim 3 wherein said pivot means includes hinges and posts about which one swings relative to the other.

5. A low profile HID light fixture as recited in claim 4 wherein said posts are fixed to said housing and said hinges are formed on said plates.

6. A low profile HID light fixture as recited in claim 5 wherein said electrical assembly and said optical assembly are each locked into place on said housing by a quarter turn fastener engaging a locking nut on a tab which is an integral part of the housings with the respective tabs and quarter turn fasteners offset to assure said electrical assembly and said optical assembly are installed on the correct sides.

7. A low profile HID light fixture as recited in claim 1 including means for balancing the weight of the fixture when it is hung.

8. A low profile HID light fixture as recited in claim 7 wherein said means for balancing said light fixture includes an adapter connected to a hanger said adapter being mounted on said housing in such a way so that its position on said housing can be adjusted.

9. A low profile HID light fixture as recited in claim 1 including two rows of tabs formed in the top of said housing and a flat sheet of high temperature polymer bowed to be installed between said two rows to form a wire access cover.

* * * * *